US007802741B2

(12) United States Patent
Werner et al.

(10) Patent No.: US 7,802,741 B2
(45) Date of Patent: Sep. 28, 2010

(54) PUMP ASSEMBLIES HAVING A QUICK-RELEASE LATCHING MECHANISM AND METHODS FOR SECURING PUMP ASSEMBLIES IN A TANK

(75) Inventors: Kurt Werner, Auburn, NY (US); David Fergot, Syracuse, NY (US); David T. Middleton, Skaneateles, NY (US); Scott H. Kennard, Hamlin, NY (US); George A. Earle, III, Clifton Park, NY (US)

(73) Assignee: Environment One Corporation, Niskayuna, NY (US)

( * ) Notice: Subject to any disclaimer, the term of this patent is extended or adjusted under 35 U.S.C. 154(b) by 184 days.

(21) Appl. No.: 12/152,403

(22) Filed: May 14, 2008

(65) Prior Publication Data

US 2009/0050721 A1 Feb. 26, 2009

Related U.S. Application Data

(63) Continuation of application No. 60/917,844, filed on May 14, 2007.

(51) Int. Cl.
*B02C 19/00* (2006.01)

(52) U.S. Cl. ..... 241/46.017; 29/426.1; 29/428; 241/46.08

(58) Field of Classification Search ..... 241/46.01, 241/46.017, 46.08, 285.1, 285.2; 417/424.1, 417/424.2; 29/426.1, 428
See application file for complete search history.

(56) References Cited

U.S. PATENT DOCUMENTS 3,300,759 A 1/1967 Chapman et al. ..... 340/150
3,362,687 A 1/1968 Hensley ..... 254/187
3,667,692 A 6/1972 Grace ..... 241/36
4,025,237 A 5/1977 French ..... 417/131
4,108,386 A 8/1978 Conery et al. ..... 241/46.11
4,123,792 A 10/1978 Gephart et al. ..... 361/30
4,197,506 A 4/1980 Fogelstrom ..... 327/271

(Continued)

OTHER PUBLICATIONS

Henry et al., pending U.S. Appl. No. 29/280,014 filed May 14, 2007 entitled "Grinder Pump Assembly".

(Continued)

*Primary Examiner*—Mark Rosenbaum
(74) *Attorney, Agent, or Firm*—Heslin Rothenberg Farley & Mesiti P.C.

(57) ABSTRACT

A pump assembly supportable in a tank having an opening includes a pump such as a grinder pump and a cover attachable to the pump. The cover has a peripherally-extending portion extending outwardly from the pump and the peripherally-extending portion is sized to rest on a first surface of the portion of the tank defining the opening. A quick-release latching mechanism may include a plurality of members such as arms or pawls which are movable generally radially between a retracted position wherein the outer ends of the plurality of members are disposed inwardly of the peripherally-extending portion of the cover allowing the pump assembly to be lowered into the opening in the tank, and an extended position wherein the outer ends of a plurality of members are positionable against a second opposite side of the portion of the tank defining the opening to compress the portion of the tank forming the opening between the cover and the plurality of members.

31 Claims, 6 Drawing Sheets

U.S. PATENT DOCUMENTS

| | | | | |
|---|---|---|---|---|
| 4,201,240 | A | 5/1980 | Case | 137/392 |
| 4,223,679 | A | 9/1980 | Schulman et al. | 607/32 |
| 4,230,578 | A | 10/1980 | Culp et al. | 210/86 |
| 4,454,993 | A | 6/1984 | Shibata et al. | 241/46.017 |
| 4,523,194 | A | 6/1985 | Hyde | 340/853.3 |
| 4,561,443 | A | 12/1985 | Hogrefe et al. | 607/31 |
| 5,235,326 | A | 8/1993 | Beigel et al. | 340/10.41 |
| 5,439,180 | A | 8/1995 | Baughman et al. | 241/36 |
| 5,553,794 | A | 9/1996 | Oliver et al. | 241/36 |
| 5,559,507 | A | 9/1996 | Beigel | 340/10.34 |
| 5,562,254 | A | 10/1996 | Sleasman et al. | 241/46.01 |
| 5,577,890 | A | 11/1996 | Nielsen et al. | 417/44.2 |
| 5,672,050 | A | 9/1997 | Webber et al. | 417/18 |
| 5,712,630 | A | 1/1998 | Nanboku et al. | 340/10.3 |
| 5,752,315 | A | 5/1998 | Sleasman et al. | 29/888 |
| 5,771,178 | A | 6/1998 | Stemporzewski, Jr. et al. | 702/45 |
| D397,763 | S | 9/1998 | Sabo | D23/203 |
| 5,816,510 | A | 10/1998 | Earle et al. | 241/46.01 |
| 5,863,194 | A | 1/1999 | Kadah et al. | 431/24 |
| 5,954,089 | A | 9/1999 | Seymour | 137/487.5 |
| 5,966,311 | A | 10/1999 | Stemporzewski, Jr. et al. | 700/281 |
| 6,046,680 | A | 4/2000 | Soenen et al. | 340/5.23 |
| 6,059,208 | A | 5/2000 | Struthers | 241/46.01 |
| 6,203,282 | B1 | 3/2001 | Morin | 417/44.1 |
| 6,632,072 | B2 | 10/2003 | Lipscomb et al. | 417/36 |
| 6,806,808 | B1 | 10/2004 | Watters et al. | 340/10.41 |
| 6,969,287 | B1 | 11/2005 | Motsenbocker | 440/1 |
| D556,293 | S | 11/2007 | Daley et al. | D23/203 |
| 2003/0025612 | A1 | 2/2003 | Holmes et al. | 340/870.02 |
| 2003/0236592 | A1 | 12/2003 | Shajii et al. | 700/282 |
| 2005/0033479 | A1 | 2/2005 | Parker | 700/282 |
| 2005/0052282 | A1 | 3/2005 | Rodgers et al. | 340/572.1 |
| 2005/0079077 | A1* | 4/2005 | Tsai et al. | 417/423.15 |
| 2005/0092838 | A1 | 5/2005 | Tsirline et al. | 235/449 |
| 2005/0136301 | A1 | 6/2005 | Knaggs et al. | 429/22 |
| 2005/0174255 | A1 | 8/2005 | Horler | 340/870.01 |
| 2006/0060685 | A1 | 3/2006 | Kowalak et al. | 241/46.017 |
| 2006/0103535 | A1 | 5/2006 | Pahlaven et al. | 340/572.1 |
| 2006/0260993 | A1 | 11/2006 | Daley et al. | 210/173 |

OTHER PUBLICATIONS

Capano et al., pending U.S. Appl. No. 11/748,231 filed May 14, 2007 entitled "Wireless Liquid Level Sensing Assemblies and Grinder Pump Assemblies Employing the Same".

Capano et al., pending PCT patent application, Application No. PCT/US08/06134 filed May 14, 2008, entitled "Wattmeter Circuit for Operating a Grinder Pump Assembly to Inhibit Operating Under Run Dry or Blocked Conditions".

Analog Devices Data Sheet, "Energy Metering IC with Integrated Oscillator and Reverse Polarity Indication", Revision A, 20 pages, 2006.

* cited by examiner

PUMP ASSEMBLIES HAVING A QUICK-RELEASE LATCHING MECHANISM AND METHODS FOR SECURING PUMP ASSEMBLIES IN A TANK

CLAIM TO PRIORITY AND CROSS-REFERENCE TO RELATED APPLICATIONS

This application claims the benefit of U.S. Provisional Application No. 60/917,844, filed May 14, 2007, entitled "Grinder Pumps And Components Therefor," the entire subject matter of which is hereby incorporated herein by reference.

This application is also related to commonly owned pending U.S. Utility patent application Ser. No. 11/748,231 filed May 14, 2007, entitled "Wireless Liquid Level Sensing Assemblies And Grinder Pump Assemblies Employing The Same" by Capano et al., and commonly owned pending U.S. Design patent application Ser. No. 29/280,014 filed May 14, 2007, entitled "Grinder Pump Assembly" by Henry et al. The entire subject matter of these applications are hereby incorporated herein by reference.

FIELD OF THE INVENTION

This invention relates generally to grinder pumps, and more particularly to latching assemblies for grinder pumps.

BACKGROUND OF THE INVENTION

Grinder pumps are often used in low pressure sewage systems for pumping sewage. A grinder pump is typically disposed in a sewage tank in which the grinder pump includes a motor for driving a grinder mechanism for cutting or grinding solids or semisolid matter in the sewage and a pump for pumping the processed sewage. Grinding solids and/or semisolid matter in the sewage allows the resulting particulate effluent to be transferred using a pump through relatively small diameter pipes without clogging.

Conventionally, grinder pumps are produced in two configurations, namely, an open wet well configuration and a closed wet well configuration.

In an open wet well configuration, a grinder pump is positioned inside a tank. The entire volume under the tank lid is considered as a single storage vessel for the wastewater that flows in and is periodically pumped out, i.e., there is no partition between the top and the bottom of the tank. Often the grinder pump is supported from the bottom of the tank on a stand.

In a closed wet well configuration, the grinder pump is located in a lower chamber of the tank that contains the wastewater flow. An upper chamber or accessway of the tank provides a passageway for the grinder pump to be installed and removed as needed. The accessway extends from the tank lid at grade level or ground level down to the upper plane of the wet well chamber. Typically in closed wet well configuration, an inwardly extending horizontal flange extends from the tank at the top of the wet well and has an opening large enough to accept the lower section of the grinder pump. The grinder pump assembly is suspended in the tank from an outwardly extending horizontal flange on the top of the grinder pump that rests on the inwardly extending horizontal flange of the tank. With the grinder pump in place, the outwardly extending horizontal flange of the grinder pump engages an inwardly extending horizontal flange of the tank around the aperture to create a continuous bulkhead separating the wet well from the accessway. Typically, often as many as twelve threaded fasteners are used to securely hold the grinder pump in place as well as provide the compressive force needed to effect a seal between the flange on the grinder pump and flange in the tank.

There is a need for improved grinder pumps, and particularly, means for securing and sealing the grinder pumps in closed wet well grinder pump stations.

SUMMARY OF THE INVENTION

In a first aspect, the present invention provides a pump assembly supportable in a tank having an opening. The pump assembly includes a pump, a cover attachable to the pump, the cover having a peripherally-extending portion extending outwardly from the pump and the peripherally-extending portion sized to rest on a first surface of a portion of the tank defining the opening, and a plurality of members movable generally radially between a retracted position wherein outer ends of the plurality of members are disposed inwardly of the peripherally-extending portion of the cover allowing the pump assembly to be lowered into the opening in the tank, and an extended position wherein the outer ends of the plurality of members are positionable against a second opposite side of the portion of the tank defining the opening to compress the portion of the tank forming the opening between the cover and the plurality of members.

In a second aspect, the present invention provides a pump assembly supportable in a tank having an opening. The pump assembly includes a pump, a cover attachable to the pump, the cover having a bottom surface supportable on an upper surface of a portion of the tank defining the opening, and single quick-release latching means for compressing the portion of the tank forming the opening between the cover and a plurality of movable members.

In a third aspect, the present invention provides a grinder pump assembly supportable in a tank having an opening. The grinder pump assembly includes a grinder pump and a cover attachable to the grinder pump. The cover has a peripherally-extending portion extending outwardly from the grinder pump and the peripherally-extending portion sized to rest on a first surface of a portion of the tank defining the opening. A seal is attached to a bottom surface of the peripherally-extending portion of the cover for engaging the first surface of the portion of the tank defining the opening. A top housing has an upper end and a lower end, and the lower end is attachable to the pump and the upper end is attachable to the cover. A quick-release latching mechanism includes a rotatable member having an axis extending through the cover, a hub attached to the rotatable member, and a plurality of members having inner ends operably connected to the hub and movable generally radially between a retracted position wherein curved outer ends of the plurality of members are disposed inwardly of the peripherally-extending portion of the cover allowing the pump assembly to be lowered into the opening in the tank, and an extended position wherein the outer ends of a plurality of members are positionable against a second opposite side of the portion of the tank defining the opening to compress the portion of the tank forming the opening between the cover and the plurality of members.

In a fourth aspect, the present invention provides method for releasably supporting a pump in a tank having an opening. The method includes providing a pump, providing a cover attachable to the pump, introducing the pump through an opening in the tank, releasably supporting the cover on a upper side of a portion of the tank forming the opening with the pump extending below the portion of the tank forming the opening, and radially extending outer ends of a plurality of members against a lower surface of the tank defining the opening to compress the portion of the tank forming the opening between the cover and the outer ends of the plurality of members.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

One aspect of the present invention is directed to quick-release latching mechanisms for securely retaining grinder pump assemblies configured in, for example, a closed wet well and providing adequate compressive force to also effect a watertight seal between the wet well and accessway portions of the tank.

Figure 1:
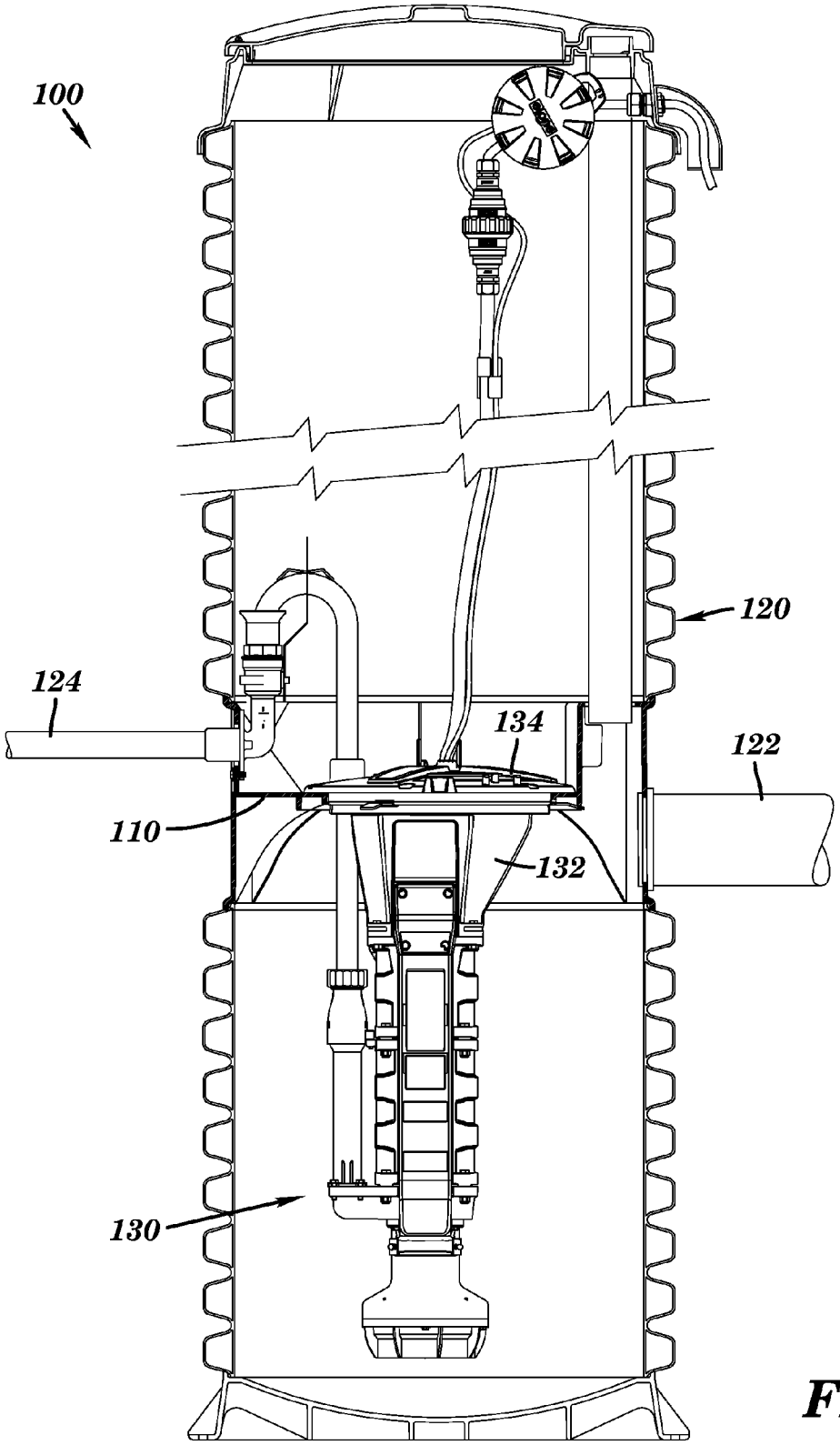
FIG. 1 is an elevational view of one embodiment of a grinder pump station employing a latching mechanism in accordance with the present invention in which a grinder pump system is disposed in an opening in a tank.

FIG. 1 illustrates one embodiment of a low-pressure grinder pump station 100 in accordance with the present invention for collecting, grinding, and pumping wastewater. Grinder pump station 100 generally includes a tank 120 and a grinder pump assembly 130. The grinder pump assembly is supported from the tank by a top housing 132 and a cover 134 in accordance with the present invention. As described below, a latching mechanism may be disposed between the cover and the top housing and used to retain the grinder pump assembly in the tank. Grinder pump station 100 is readily installable in the ground by connecting the station to a wastewater feed pipe 122, a wastewater discharge pipe 124, and an electrical power supply via an electrical cable (not shown). The system may also be connected to or include a vent.

Figure 2:
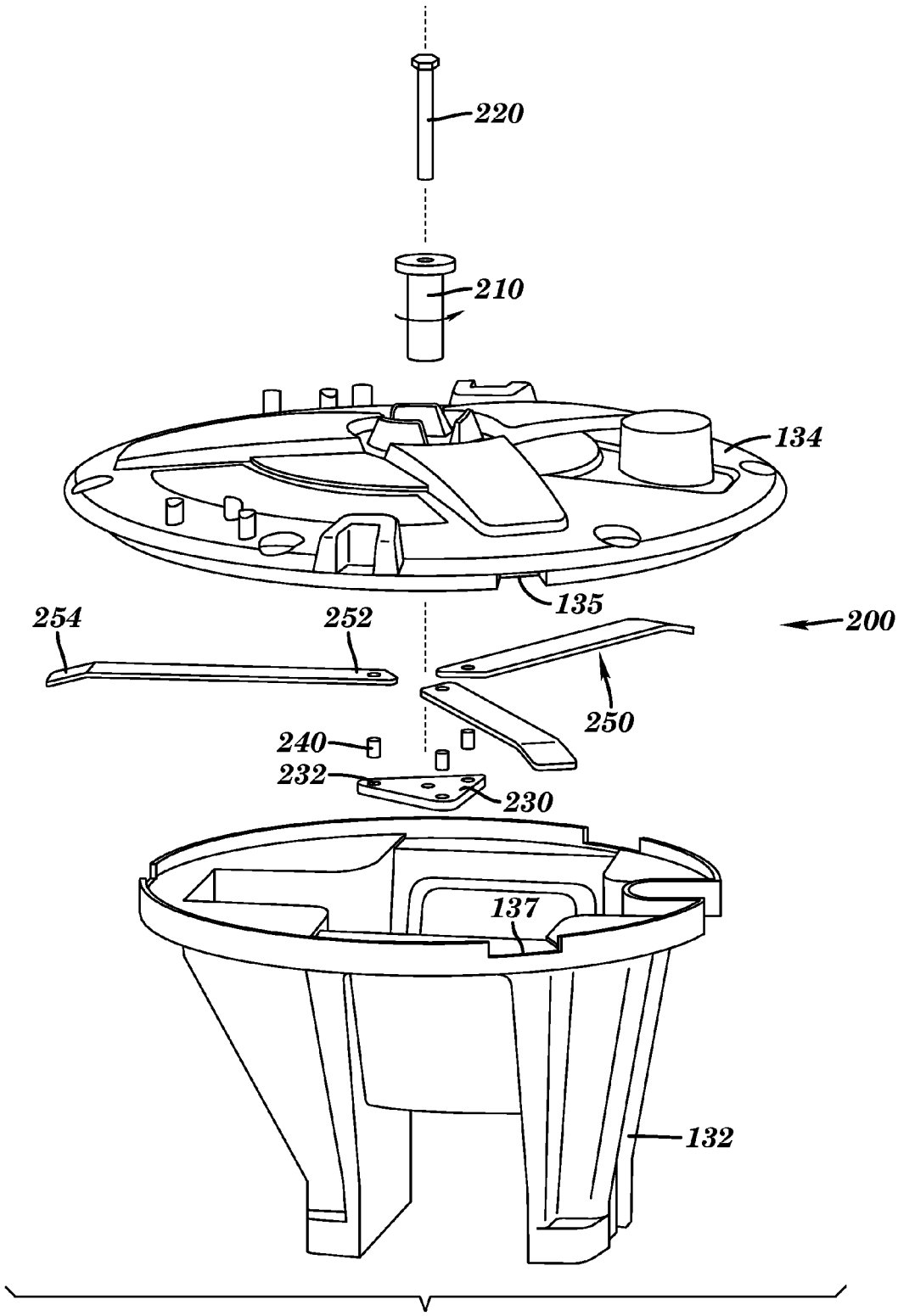
FIG. 2 is an exploded perspective view of the latching mechanism of the grinder pump station of FIG. 1.

FIG. 2 illustrates an exploded view of one embodiment of a latching mechanism 200, top housing 132, and cover 134 in accordance with the present invention. Latching mechanism 200 may include a vertical center spindle 210, a rotatable member or bolt 220, a hub base 230, a plurality of pins 240, and a plurality of elongated members such as arms or pawls 250.

Vertical center spindle 210 is axially restrained and rotatable within a centrally disposed hole in a cover 134. Disposed through spindle 210 is bolt 220 which may include a hexagonal head that can be driven with conventional tools such as a socket wrench. Hub base 230 includes a centrally located hole and the hub base is secured to the bottom of spindle 210 by a nut (not shown) attached to bolt 220. Hub base 230 may have a generally triangular shape with holes 232 disposed adjacent each corner. The holes may be disposed at generally the same distance from the center of the hub base. It will be appreciated that a circular shaped hub base or other shaped base may be suitably employed.

Suitable O-rings may be employed for forming a seal between spindle 210 and the hole in cover 134. For example, a first O-ring may be disposed between the top flange (around the spindle and of spindle 210 and the top cover 134). A second O-ring may be disposed around the spindle and between the bottom of cover 134 and the top of hub base 230. In another example, the spindle may have one or more circumferentially extending cutouts extending around the spindle for receiving the one or more O-rings therein. In this configuration, the outer surface of the O-rings engages the inside of the center hole in the cover to form a seal.

Each of the plurality of pawls 250 has a first inner end 252 which includes a hole and an opposite second outer end 254. The inner ends of the pawls are pivotally attached to the corners of the hub base with the plurality of pins 240. The elongated pawls are positioned generally horizontally, just above the plane of the hub base within the confines of the cover.

Figure 3:
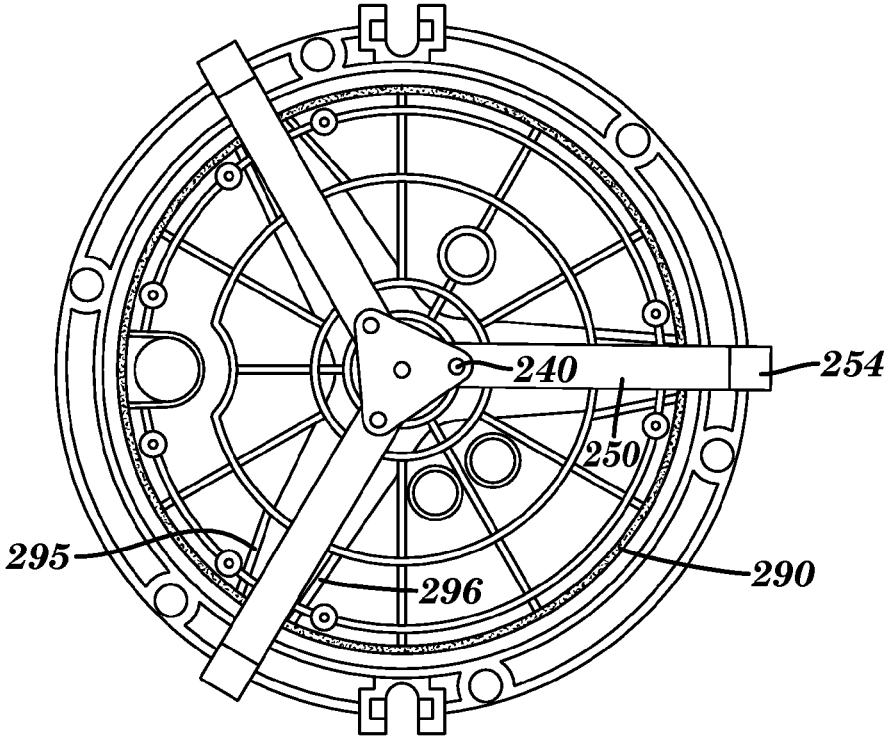
FIG. 3 is a bottom view of the latching mechanism and cover of FIG. 2 in an extended or locked position.

As shown in FIG. 3, the distance from the center of the spindle to the center of the pins 240, and the length and width of the radially outwardly extending pawls 250 may be sized so that in a fully extended position, each end 254 of the pawl projects outwardly, through a channel formed by a cutout 135 (FIG. 2) formed in cover 134 and a cutout 137 formed in top housing 132, beyond a point equivalent to the radius of the aperture formed in the inwardly extending horizontal flange 110 (FIG. 1) in tank 120 (FIG. 1).

Figure 4:
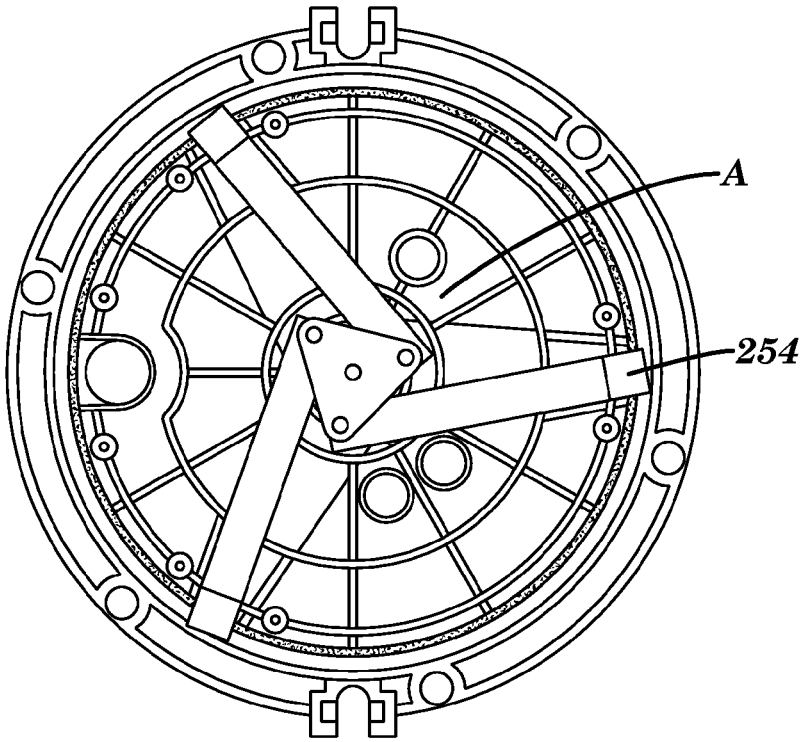
FIG. 4 is a bottom view of the latching mechanism and cover of FIG. 2 in a retracted or unlocked position.

As shown in FIG. 4, the distance from the center of the spindle to the center of the pins 240, and the length and width of pawls 250 is also selected so that in a retracted position, when the spindle is rotated in the direction of arrow A, each of ends 254 of pawls 250 are retracted within the cover and within the radius of the aperture in the tank and desirably within the radius of a seal 290.

In the retracted position as shown in FIG. 4, the grinder pump assembly may be set in place within the opening of the flange of the wet well. Once positioned, the center spindle can be rotated, for example, less than a half revolution, to rotate the hub base with the pins which act as cams to apply a generally horizontal, outwardly directed force on the pawls driving them through their respective channels initially along a chord and toward a radial path and under the lower surface of the flange of the wet well. Once the pawls have been deployed outward under the flange of the wet well, the grinder pump unit is secured in place within the tank.

Figure 5:
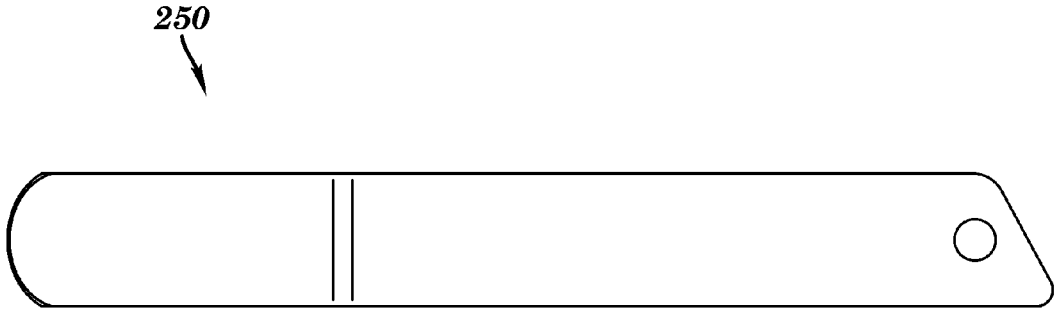
FIG. 5 is an enlarged top view of one of the plurality of members or pawls of the latching mechanism of FIG. 2.

As shown in FIGS. 4 and 5, the cover may include guides 295 and 296 for guiding the sides of pawls 250 when they are moved between a retracted position and an extended position.

Figure 6:
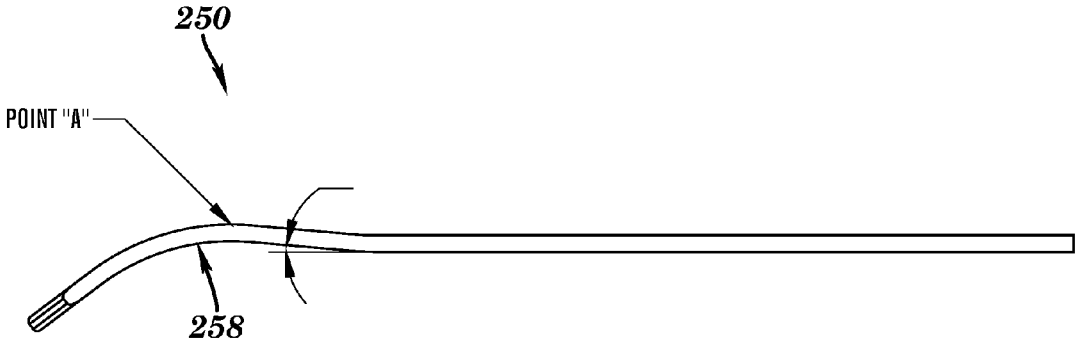
FIG. 6 is an enlarged side elevational view of the member or pawl of FIG. 5.

With regard to FIGS. 5 and 6, by forming the ends of pawls 250 with a varying geometry or sloped portion 258, the amount of torque needed to drive the actuating spindle and the amount of compressive force created on the sealing means may be altered. For example, the curved shape of the ends of the pawls may be selected so that the force required may be lessened by decreasing the slope of the end of the pawl.

Further, the curved shape of the ends of the pawls may be selected so that the force or torque required to lock the latching mechanism is relatively constant throughout the rotation of the spindle. The number of pawls can also be varied depending on the needs of the application.

The mating of these two flanges create a watertight seal capable of withstanding a nominal amount of water pressure in either cavity. For example, the underside of the cover may have a groove in which is received seal 290 such as an extruded foam EPDM (ethylene propylene diene monomer) rubber. The grinder pump assembly is also secured in place to resist motion caused by vibration of the grinder pump assembly, discharge pressures, inflow, etc.

An advantage of the latching mechanism for use with the installation and removal of a grinder pump assembly in a wet well of a tank, is the ability of a user to attach and release the grinder pump assembly from the tank with a single action, e.g., using a socket wrench.

Many conventional grinder pump stations having a wet well can have accessways as deep as 12 feet or more feet thereby requiring a service technician to use specialized wrenches that will extend an equivalent distance downward. The deeper the station, the more time consuming it can be to locate each of the upwards of 12 fasteners with the elongated wrench in order to remove or install the grinder pump assembly. Compared to conventional grinder pump stations attached with a plurality of bolts, the present invention as described above, reduces the time and effort required in installing and removing a grinder pump assembly from a tank.

From the present description, it will be appreciated that the grinder pump assembly may be positioned in a tank having only a wet well, i.e., not having a dry well portion or accessory.

Another aspect of the present invention is directed to a monolithic or one-piece cutting wheel for a grinder pump cutting mechanism.

Figure 7:
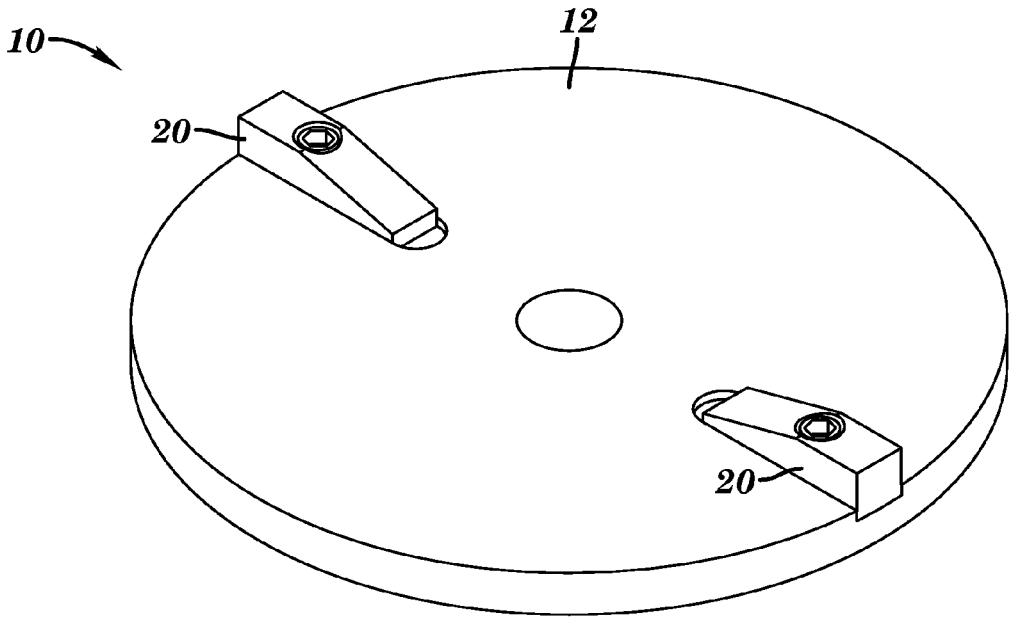
FIG. 7 PRIOR ART
FIG. 7 is a bottom perspective view of a prior art cutting wheel for a grinder pump.
Figure 8:
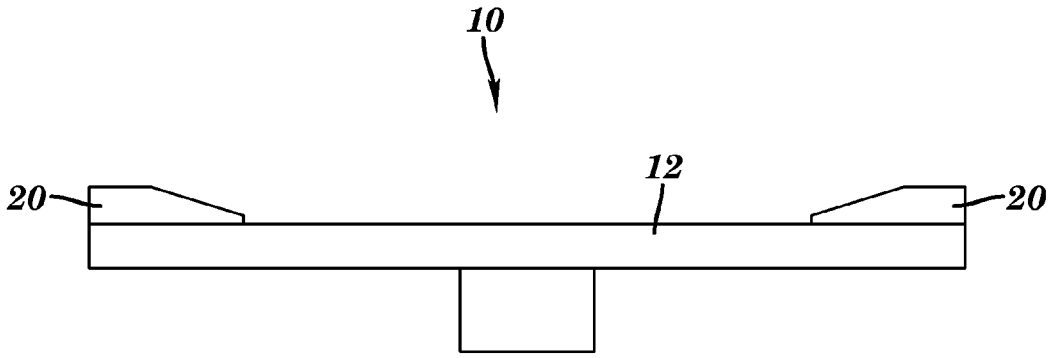
FIG. 8 PRIOR ART
FIG. 8 is a side elevation view of the prior art cutting wheel of FIG. 7.

Conventional grinder pump assemblies typically have a cutting mechanism that employs a rotating cutting wheel within a stationary ring. The stationary ring has a large number of cutting surfaces oriented generally axially or perpendicular to the direction of rotation. As shown in FIGS. 7 and 8, a typical prior art rotating cutting wheel 10 has a disc-shaped base 12 and separately attachable elongated cutting elements 20. These cutting elements have sharp cutting edges oriented axially or near axially as well. The cutter wheel's outside diameter is nearly equivalent in dimension to the stationary ring's outside diameter assuring the clearance between rotating and stationary cutting edges is kept as small as practical to improve cutting efficiency. The cutting elements are typically produced from a harder, more durable material to withstand the wear of cutting. Since suitable cutting materials will tend to be more expensive, the overall cutting wheel will oftentimes be made from an inexpensive material such as cast iron with the more exotic cutting material such as stainless steel formed into cutting elements and mounted to the cutting wheel. The elongated cutting elements on the rotating wheel agitates the wastewater in the tank during operation. This agitation keeps the solids in suspension during pumping cycles.

Figure 9:
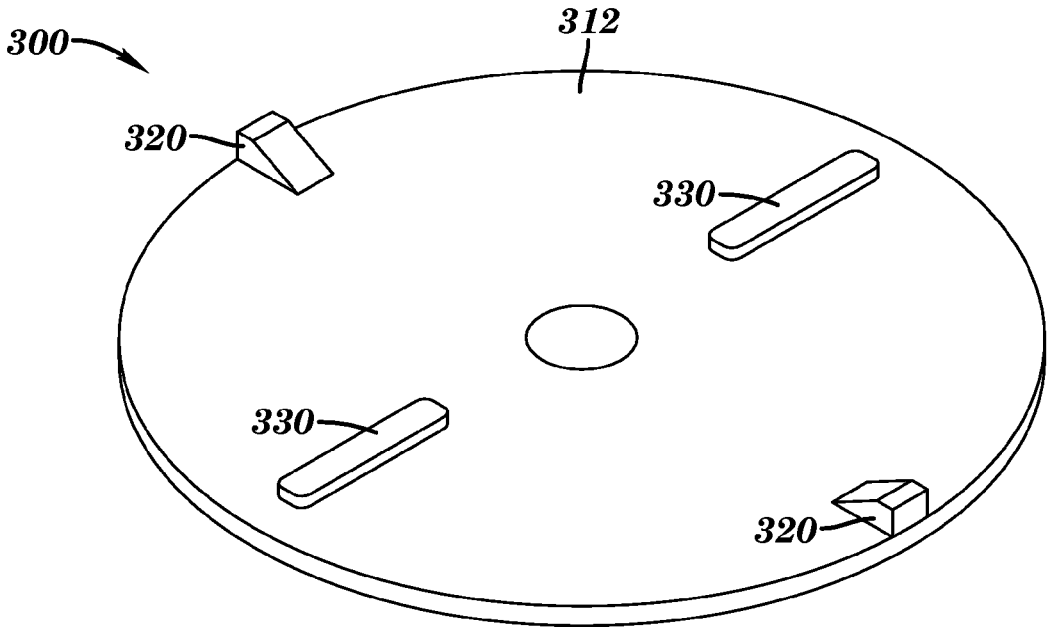
FIG. 9 is a bottom perspective view of one embodiment of a cutting wheel in accordance with the present invention for use in a grinder pump.

FIG. 9 illustrates one embodiment of a cutting wheel 300 in accordance with the present invention. Cutting wheel 300 includes a disc-shaped base portion 312, a plurality of cutting elements 320 and a plurality of paddle elements 330. The paddle elements allow the level of agitation to be controlled independently of the cutting teeth geometry. Cutting elements 320 may be sized smaller than the cutting elements of conventional cutting wheels.

Cutting wheel 300 may be formed from a single forging which creates the raised cutting elements as well as the paddle elements. Secondary processes such as turning or milling can be used to achieve the dimensional requirements after forging. Other forming processes such as investment casting, sintering, and metal injection molding may be employed as well. The cutting wheel may be fabricated from a suitable corrosion and abrasion resistant material. Hard chrome plating may also be employed to enhance the cutting wheels corrosion and abrasion resistance. Since the cutting edges must withstand wear and erosion over time, they can be selectively hardened, for example, with a method such as induction hardening.

A benefit of the a single-piece cutting wheel in accordance with the present invention is that the cutting wheel may be made smaller or with tighter tolerances compared to conventional cutting wheels where the cutting elements are attached to a disc-shaped base. For example, in a conventional cutting wheel, the cutting elements that are mounted to the rotating base limits the tolerance to which the outside diameter of the wheel can be held and results in a compromise in achievable clearances between the stationary and rotating cutting elements and negatively impact cutting effectiveness. By forming a monolithic or single-piece cutting wheel with integrally formed cutting elements overcomes the tolerances associated with the attaching of separate cutting elements in conventional cutting wheels.

In addition, by separating the cutting function from the agitation function, the paddles elements can be oriented with respect to the cutting elements to provide for agitation to keep the solids in suspension, as well as minimizing the localized turbulence at the region of cutting. This minimizes the turbulence that may prevent suspended solids in the wastewater from flowing into the cutting action between the cutting elements of the cutting wheel and the cutting elements of the stationary ring during the pumping cycles.

For example, the size of the cutting wheel may be about 6 inches in diameter, the cutting elements ⅜ inch high and ½ inch long, and the paddle elements may have a height of ⅛ inch and a width of 1 inch.

Figure 10:
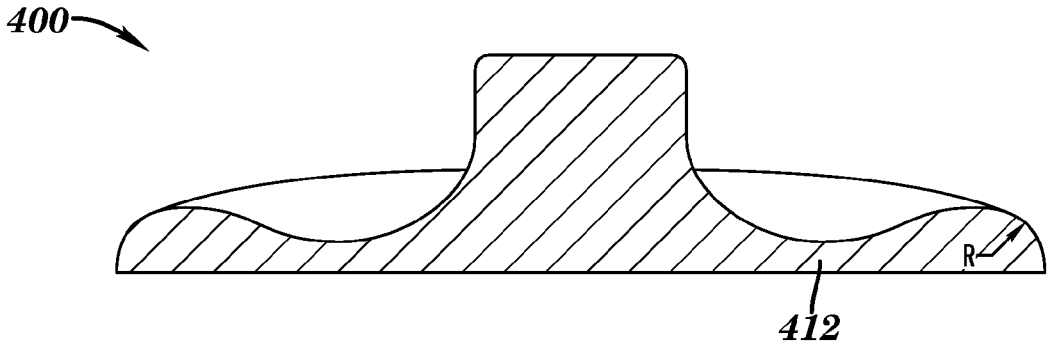
FIG. 10 is a side elevation view of another embodiment of a cutting wheel in accordance with the present invention.

FIG. 10 illustrates another embodiment of a cutting wheel 400 in accordance with the present invention. Cutting wheel 400 includes a base portion 412 having a cross-sectional profile that may improves the flow characteristics past the cutting region between the cutting elements (not shown) of the wheel, and into the inlet of the pump. For example, using gradual radii R instead of a sharp corner profile the inflow between the cutter and the pump inlet can be less disruptive. The combination of the improved cross-sectional profile, paddle elements (not shown) may be provided to allow the grinder pump unit to run more efficiently wasting less energy on excessive agitation and inlet friction head. As described above, cutting wheel 400 may be a monolithic or one-piece cutting wheel.

In addition, the cutter wheel profile can be optimized to increase the mass moment of inertia of the wheel. This inertia, or flywheel effect, helps to prevent jamming during grinding of rigid or tough materials.

In conventional grinder pump cutting wheels, the agitation has been a by-product of the size of the cutting elements rather than a purpose-designed attribute. Also, by making the cutting teeth larger to aid in mounting to the rotating wheel or to deliberately increase agitation of the wastewater, excessive, localized turbulence can be created near the rotating cutter teeth thereby making it difficult for suspended solids to flow into the cutting region and be properly macerated. There turbulence may tend to push flow away from the cutting action. Thus, the present invention for a cutting wheel may allow using smaller sized cutting teeth and spaced apart paddle elements may avoid some of the drawbacks of conventional grinder pump cutting wheels.

Thus, while various embodiments of the present invention have been illustrated and described, it will be appreciated to those skilled in the art that many changes and modifications may be made thereunto without departing from the spirit and scope of the invention.

The invention claimed is:

1. A pump assembly supportable in a tank having an opening, said pump assembly comprising:

a pump;

a cover attachable to said pump, said cover having a peripherally-extending portion extending outwardly from said pump and said peripherally-extending portion sized to rest on a first surface of a portion of the tank defining the opening; and a plurality of members movable generally radially between a retracted position wherein outer ends of said plurality of members are disposed inwardly of the peripherally-extending portion of said cover allowing said pump assembly to be lowered into the opening in the tank, and an extended position wherein said outer ends of said plurality of members are positionable against a second opposite side of the portion of the tank defining the opening to compress the portion of the tank forming the opening between said cover and said plurality of members.

2. The pump assembly of claim 1 further comprising a rotatable member operably attachable to said plurality of members and rotatable about an axis to move said plurality of members between said retracted position and said extended position.

3. The pump assembly of claim 2 wherein said rotatable member comprises a single rotatable member.

4. The pump assembly of claim 3 wherein said single rotatable member is rotatable using a wrench to move said plurality of members between said retracted position and said extended position.

5. The pump assembly of claim 3 wherein said rotatable member is rotatable less than about half a turn about the axis to move said plurality of members between said retracted position and said extended position.

6. The pump assembly of claim 1 wherein said outer ends of said plurality of members comprise curved outer ends.

7. The pump assembly of claim 1 wherein said outer ends of said plurality of members comprises curved outer ends resulting in a generally constant force required to move said plurality of members to said extended position to compress the portion of the tank forming the opening between said cover and said plurality of members.

8. The pump assembly of claim 1 wherein said plurality of members comprises three members spaced about 120 degrees apart from each other.

9. The pump assembly of claim 1 further comprising a hub attached to inner ends of said plurality of elongated members.

10. The pump assembly of claim 1 further comprising a seal attached to a bottom surface of said peripherally-extending portion of said cover for engaging the top surface of the portion of the tank defining the opening.

11. The pump assembly of claim 1 further comprising a top housing having an upper end and a lower end, said lower end attachable to the pump and said upper end attachable to said cover.

12. The pump assembly of claim 1 further comprising a plurality of cutouts disposed in at least one of said cover and said top housing through which said outer ends of said plurality of members are movable.

13. The pump assembly of claim 1 wherein said cover comprises a plurality of guides for guiding movement of said plurality of members between said retracted position and said extended position.

14. The pump assembly of claim 1 further comprising the tank having the opening in which said pump is supported.

15. The pump assembly of claim 14 wherein said pump is supported in a transition zone between a wet well and a dry well of the tank.

16. The pump assembly of claim 1 wherein said pump comprises a grinder pump.

17. A grinder pump assembly supportable in a tank having an opening, said grinder pump assembly comprising:

a grinder pump;

a cover attachable to said grinder pump, said cover having a peripherally-extending portion extending outwardly from said grinder pump and said peripherally-extending portion sized to rest on a first surface of a portion of the tank defining the opening;

a seal attached to a bottom surface of said peripherally-extending portion of said cover for engaging the first surface of the portion of the tank defining the opening;

a top housing having an upper end and a lower end, said lower end attachable to said grinder pump and said upper end attachable to said cover; and a quick-release latching mechanism comprising:

a rotatable member having an axis extending through said cover;

a hub attached to said rotatable member; and a plurality of members having inner ends operably connected to said hub and movable generally radially between a retracted position wherein curved outer ends of said plurality of members are disposed inwardly of said peripherally-extending portion of said cover allowing the pump assembly to be lowered into the opening in the tank, and an extended position wherein said outer ends of said plurality of members are positionable against a second opposite side of the portion of the tank defining the opening to compress the portion of the tank forming the opening between said cover and said plurality of members.

18. The pump assembly of claim 17 wherein said rotatable member is rotatable using a wrench to move said plurality of members between said retracted position and said extended position.

19. The pump assembly of claim 17 wherein said rotatable member is rotatable less than about half a turn about said axis to move said plurality of members between said retracted position and said extended position.

20. The pump assembly of claim 17 wherein said outer ends of said plurality of members comprises curved outer ends resulting in a generally constant force required to move said plurality of members to said extending position to compress the portion of the tank forming the opening between said cover and said plurality of members.

21. The pump assembly of claim 17 further comprising a plurality of cutouts disposed in at least one of said cover and said top housing through which said outer ends of said plurality of members are moveable.

22. The pump assembly of claim 17 wherein said cover comprises a plurality of guides for guiding movement of said plurality of members between said retracted position and said extended position.

23. The pump assembly of claim 17 further comprising the tank having the opening in which said grinder pump is supported.

24. The pump assembly of claim 23 wherein said grinder pump is supported in a transition zone between a wet well and a dry well of the tank.

25. A method for releasably supporting a pump in a tank having an opening, the method comprising:

providing a pump;

providing a cover attachable to the pump;

introducing the pump through an opening in the tank;

releasably supporting the cover on a upper side of a portion of the tank forming the opening with the pump extending below the portion of the tank forming the opening; and radially extending outer ends of a plurality of members against a lower surface of the tank defining the opening to compress the portion of the tank forming the opening between the cover and the outer ends of the plurality of members.

26. The method of claim 25 wherein the extending comprises rotating a hub attached to inner ends of the plurality of members to simultaneously move the plurality of members.

27. The method of claim 26 wherein the rotating comprises rotating a hub attached to inner ends of the plurality of members less than a half turn to compress the portion of the tank forming the opening between the cover and the plurality of members.

28. The method of claim 25 wherein the extending comprises rotating a hub disposed in the center of the cover and attached to inner ends of the plurality of members, and wherein the plurality of members are disposed generally about 120 degrees apart from each other.

29. The method of claim 25 wherein the extending comprises using a wrench to rotate a rotatable member operably attached to inner ends of the plurality of members.

30. The method of claim 25 further comprising providing a seal between the cover and the portion of the tank forming the opening to inhibit the transfer of fluid through the opening.

31. The method of claim 25 wherein the pump comprises a grinder pump.

* * * * *